US005384303A

United States Patent [19]

Nishimura et al.

[11] Patent Number: 5,384,303

[45] Date of Patent: Jan. 24, 1995

[54] THERMOSENSITIVE RECORDING MATERIAL

[75] Inventors: Masaki Nishimura, Tokyo; Kunitaka Toyofuku, Sakura, both of Japan

[73] Assignee: New Oji Paper Co., Ltd., Tokyo, Japan

[21] Appl. No.: 916,693

[22] Filed: Jul. 22, 1992

[30] Foreign Application Priority Data

Sep. 30, 1991 [JP] Japan ..... 3-251364

[51] Int. Cl.[6] ..... B41M 5/34

[52] U.S. Cl. ..... 503/209; 503/216; 503/225

[58] Field of Search ..... 427/150–152; 503/208, 209, 216, 225

[56] References Cited

FOREIGN PATENT DOCUMENTS

| | | |
|---|---|---|
| 2327135 | 12/1973 | Germany . |
| 43-4160 | 2/1968 | Japan . |
| 45-14039 | 5/1970 | Japan . |
| 48-27736 | 8/1973 | Japan . |
| 52-140483 | 11/1977 | Japan . |
| 56-146794 | 11/1981 | Japan . |
| 58-5288 | 1/1983 | Japan . |
| 58-199189 | 11/1983 | Japan . |
| 59-93387 | 5/1984 | Japan . |
| 59-114096 | 6/1984 | Japan . |
| 59-167292 | 9/1984 | Japan . |
| 60-78782 | 5/1985 | Japan . |
| 60-219088 | 11/1985 | Japan . |
| 62-164579 | 7/1987 | Japan . |

OTHER PUBLICATIONS

Patent Abstracts of Japan, vol. 13, No. 593 (M-914), 27 Dec. 1989, and JP-A-01 249 385, 4 Oct. 1989.

Patent Abstracts of Japan, vol. 11, No. 218 (M-607), 15 Jul. 1987, and JP-A-62 033 678, 13 Feb. 1987.

Patent Abstracts of Japan, vol. 6, No. 117 (M-139), 30 Jun. 1982, and JP-A-57 045 093, 13 Mar. 1982.

Patent Abstracts of Japan, vol. 4, No. 132 (M-32), 17 Sep. 1980, and JP-A-55 087 596, 2 Jul. 1980.

*Primary Examiner*—B. Hamilton Hess

*Attorney, Agent, or Firm*—Armstrong, Westerman, Hattori, McLeland & Naughton

[57] ABSTRACT

A thermosensitive recording material capable of forming colored images having an excellent resistance to oily and fatty substances and plasticizers, even immediately after the formation of the colored image, comprises a thermosensitive colored image-forming layer formed on a substrate sheet and comprising a substantially colorless dye precursor, a color-developing agent comprising at least one diphenolcarboxylic acid compound of the formula (I)

wherein $R^1$, $R^2$=H, halogen, alkyl, alkoxyl, acryl or aryl, $R^3$=H or alkyl, and n=0 or 1 to 8, a binder, and optionally, a colored image-stabilizing agent comprising at least one member selected from organic aziridine and epoxy compounds.

6 Claims, No Drawings

THERMOSENSITIVE RECORDING MATERIAL

BACKGROUND OF THE INVENTION

1. Field of the Invention

The present invention relates to a thermosensitive recording material on which colored images are formed by a heat-printing operation. More particularly, the present invention relates to a thermosensitive recording material capable of recording and maintaining thereon colored images without a fading of the images over a long time.

The thermosensitive record material of the present invention is able to record thereon colored images exhibiting an excellent resistance to moisture, heat, oily and fatty substances, and plasticizers, and thus has a superior persistency when stored for a long time, and therefore is useful as colored image-recording sheets for use in cash dispensers, as recording sheets for passenger tickets, commuter passes, labels such as POS labels, cards such as prepaid cards, and transit passes, and as printing sheets for use in facsimiles, word processors and CRT image printers. The possibility of a contact of the colored images recorded on the above-mentioned sheets, cards, or labels with the oily and fatty substances and plasticizers is very high.

2. Description of the Related Arts

It is known that a conventional thermosensitive recording material comprises a supporting substrate, for example, a paper sheet, and a thermosensitive colored image-forming layer formed on a surface of the supporting substrate and comprising an electron-donative dye precursor, for example, a leuco basic dye, an electron-acceptive color-developing agent consisting of an organic acid substance, for example, a phenol compound, and a binder. When the thermosensitive colored image-forming layer is heated imagewise, colored images are recorded thereon by a reaction of the dye precursor with the color-developing agent.

This type of thermosensitive recording material is disclosed in Japanese Examined Patent Publication Nos. 43-4,160 and 45-14,039 and Japanese Unexamined Patent Publication No. 48-27,736 and is widely employed in practice.

Namely, the thermosensitive recording material is advantageous in that colored images can be easily 10 formed by heating alone, and the recording apparatus can be made relatively compact and small in size, has a low cost, and is easily maintained, and thus is useful as an information-recording material for various outputs or printers used with, for example, computers, facsimile machines, automatic ticket-vending machines, CD-ATM, order slip-printing machines for use in restaurants, and scientific measurement recorders.

Nevertheless, the conventional dye-forming type thermosensitive recording materials in which the thermosensitive colored image-forming layer comprises a conventional color-developing agent together with the dye precursor and the binder is disadvantageous in that the reaction of the dye precursor with the color-developing agent is reversible, and thus the resultant colored images fade with the elapse of time. This fading of the colored images is accelerated by exposure to light, high temperatures, and high humidity and promoted by contact with an oily or fatty substance or a plasticizer, and the colored images fade to an extent such that the faded images cannot be recognized.

With the expansion of the scope of application of the thermosensitive recording materials, the possibility of contact of the thermosensitive recording materials with cosmetic creams, oils, or plastic polymer articles containing plasticizers, or of exposure to hard conditions, for example, high temperature and high humidity, is increased. For example, when colored images formed in a thermosensitive recording material containing a conventional color developing agent comprising 2,2-bis(4-hydroxyphenyl)propane, i.e., bisphenol A, or benzyl p-hydroxybenzoate (disclosed in Japanese Unexamined Patent Publication No. 52-140,483) is exposed to a high temperature and high humidity condition, the color density of the colored images is lowered. Also, when brought into contact with the plasticizer or the oil or fat substance, the colored images are faded and become unreadable.

Many attempts have been made to inhibit the color-fading of the colored images formed on the conventional thermosensitive colored image-forming layer containing a substantially colorless dye precursor comprising a lactone ring compound.

For example, Japanese Unexamined Patent Publication Nos. 60-78,782, 59-167,292, 59-114,096 and 59-93,387 disclose a thermosensitive colored image-forming layer containing a phenolic antioxidant.

Japanese Unexamined Patent Publication No. 56-146,794 discloses a protective layer formed from a hydrophobic polymeric compound emulsion on a thermosensitive colored image-forming layer.

Japanese Unexamined Patent Publication No. 58-199,189 discloses an intermediate layer formed from a water-soluble polymeric compound solution or a hydrophobic polymeric compound emulsion on a thermosensitive colored image-forming layer, and a surface layer formed from a solution of a hydrophobic polymer in a solvent on the intermediate layer.

Japanese Unexamined Patent Publication Nos. 62-164,579 and 60-219,088 disclose a thermosensitive colored image-forming layer containing an additive consisting of an epoxy compound and/or an aziridine compound.

In the thermosensitive colored image-forming layer containing the phenolic antioxidant, the resultant colored images exhibit a higher resistance to heat and moisture and a longer persistency in the ambient atmosphere than those of a conventional colored image-forming layer free from the phenolic antioxidant, but the improvement in the storage stability of the resultant colored images is still not satisfactory. Also, the phenolic antioxidant does not effectively enhance the resistance of the colored images to oily or fatty substances, for example, salad oil, and plasticizers, for example, dioctyl phthalate. The resistance of the colored images to oily or fatty substance or plasticizer is determined in such a manner that an oily or fatty substance, for example, a salad oil, or a plasticizer, is brought into contact with colored images, the colored images are left in contact with the oily or fatty substance or the plasticizer for a predetermined time, and then a retention of the color density of the tested colored images is measured in comparison with an initial color density thereof.

When the protective layer or the intermediate and surface layers are formed on the thermosensitive colored image-forming layer, the resultant colored images have a satisfactory resistance to the oily and fatty substances and to the plasticizers and exhibit a significantly enhanced storage persistency when the salad oil or the dioctyl phthalate is brought into contact with the colored image-forming surface of the recording material. Nevertheless, when the salad oil or the dioctyl phthalate is brought into contact with an edge face of the recording material, it penetrates into the inside of the recording material and causes the colored images to be substantially completely faded. Therefore, the provision of the protecting layer or the intermediate and surface layer cannot completely eliminate the undesirable color-fading of the images.

The addition of the epoxy compound and/or aziridine compound to the colored image-forming layer is unsatisfactory in that it takes a long time to satisfactorily stabilize the colored images formed on the colored image-forming layer by a heat-recording operation, and therefore, if an oily or fatty substance, for example, salad oil, or a plasticizer, for example, dioctyl phthalate, is brought into contact with the colored image-forming layer immediately after the heat-recording operation, the resultant colored images are faded to a great extent.

SUMMARY OF THE INVENTION

An object of the present invention is to provide a thermosensitive recording material allowing colored images formed thereon to exhibit an excellent resistance to oily and fatty substances and to plasticizers even immediately after the formation of the colored images, and thus have a superior persistency over a long time.

The above-mentioned objects can be attained by the thermosensitive recording material of the present invention, which comprises a sheet substrate and a thermosensitive colored image-forming layer formed on a surface of the sheet substrate and comprising a substantially colorless dye precursor, a color developing agent reactive with the dye precursor upon heating to thereby develop a color, and a binder, the color developing agent comprising at least one diphenol carboxylic acid compound of the formula (I):

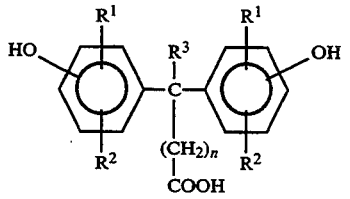

(I)

from each other represent a member selected from the group consisting of hydrogen and halogen atoms and alkyl, alkoxyl, acyl and aryl groups, $R^3$ represents a member selected from the group consisting of a hydrogen atom and alkyl groups, and n represents zero or an integer of from 1 to 8, and the colored image-forming layer further comprising a colored image-stabilizing agent comprising at least one member selected from the group consisting of organic aziridine compounds having at least one aziridinyl group and organic epoxy compounds having at least one epoxy group.

In the thermosensitive recording material of the present invention, a thermosensitive colored image-forming layer is arranged on a surface of a sheet substrate and comprises a substantially colorless dye precursor, a specific color developing agent reactive with the dye precursor upon heating to thereby develop a color, a specific colored image-stabilizing agent, and a binder.

The color developing agent of the present invention comprises at least one diphenol carboxylic acid compound of the formula (I).

In the formula (I), the halogen atoms represented by $R^1$ and $R^2$ are preferably chlorine and bromine atoms. The alkyl groups represented by $R^1$ and $R^2$ preferably have 1 to 4 carbon atoms and are selected from the group consisting of methyl, ethyl, propyl, and butyl groups. The alkoxyl groups represented by $R^1$ and $R^2$ preferably have 1 to 2 carbon atoms and are selected from the group consisting of methoxy, and ethoxy groups. The acyl groups represented by $R^1$ and $R^2$ preferably have 2 to 5 carbon atoms and are selected from the group consisting of —OC—$CH_3$, —OC—$C_2H_5$, —OC—$C_3H_7$, and —OC—$C_4H_9$, groups. The aryl groups represented by $R^1$ and $R^2$ are preferably selected from phenyl, and naphthyl groups.

Preferably, the diphenol carboxylic acid compounds of the formula (I) are selected from the group consisting of bis(4-hydroxyphenyl)acetic acid, 3,3-bis(4-hydroxyphenyl)butanic acid, 4,4-bis(4-hydroxyphenyl)pentanic acid, 2,2-bis(4-hydroxyphenyl)propionic acid, 4,4-bis(4-hydroxyphenyl)hexanic acid, 6,6-bis(4-hydroxyphenyl)heptanic acid, 4,4-bis(4-hydroxyphenyl)octanic acid, 2,2-bis(3-methyl-4-hydroxyphenyl)propionic acid, 3,3-bis(3-methyl-4-hydroxyphenyl)butanic acid, 4,4-bis(3-methyl-4-hydroxyphenyl)tentanic acid, 4,4-bis(2-methyl-4-hydroxyphenyl)pentanic acid, 3,3-bis(4-hydroxyphenyl)propionic acid, 4,4-bis(4-hydroxyphenyl)butanic acid, 3,3-bis(3-hydroxyphenyl)butanic acid, 3,3-bis(3-methoxy-4-hydroxyphenyl)butanic acid, 3,3-bis(3-chloro-4-hydroxyphenyl)butanic acid, 3,3-bis(3-acetyl-4-hydroxyphenyl)butanic acid, and 3,3-bis(3-phenyl-4-hydroxyphenyl)butanic acid.

The diphenol carboxylic acid compounds of the formula (I) can be employed alone or as a mixture of two or more thereof.

The mechanism by which the diphenol carboxylic acid compound used as a color developing agent causes the resultant colored images to exhibit an enhanced resistance to oily and fatty substances and plasticizers has not yet been clear. Nevertheless, it is assumed that, when the colored image-forming layer is heated image-wise, the diphenol carboxylic acid compound reacts at the carboxylic group thereof with an aziridine or epoxy compound used as a colored image-stabilizing agent, to produce a chemical substance insoluble in the oily and fatty substances and the plasticizers, and this insoluble chemical substance effectively protects the colored images from undesirable fading thereof.

In the thermosensitive colored image-forming layer of the present invention, the color developing agent optionally contains at least one conventional color-developing compound in addition to the diphenol carboxylic acid compound of the formula (I), to further enhance the color-forming performance of the colored image-forming layer.

The conventional color developing compound is preferably selected from the group consisting of 2,2-bis(4-hydroxyphenyl)propane (namely bisphenol A), 1,1-bis(4-hydroxyphenyl)-l-phenylethane, 1,4-bis(1-methyl-1-(4'-hydroxyphenyl)ethyl)benzene, 1,3-bis(1-methyl-1-(4'-hydroxypheny)ethyl)benzene, dihydroxydiphenylether (disclosed in JP-A-180,382), benzyl p-hydroxy-benzoate (disclosed in JP-A-52-140,483), bisphenol S, 4-hydroxy-4'-isopropyl-oxydiphenylsulfone (disclosed in JP-A-60-13,852), 1,1-di-(4-hydroxyphenyl)cyclohexane, 1,7-di(4-hydroxyphenylthio)-3,5-dioxaheptane (disclosed in JP-A-59-52,694), and 3,3'-diallyl-4,4'-dihydroxydiphenylsulfone (disclosed in JP-A-60-208,286).

The above-mentioned conventional color developing compounds can be employed alone or as a mixture of two or more thereof.

In the colored image-forming layer of the present invention, the colored image-stabilizing agent comprises at least one member selected from the group consisting of organic aziridine compounds having at least one aziridinyl group, i.e., ethyleneimine group, of the formula:

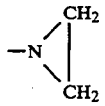

and organic epoxy compounds having at least one epoxy group of the formula:

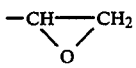

which will be represented by an abbreviated formula:

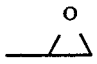

The organic aziridine compounds usable for the colored image-stabilizing agent are preferably selected from the group consisting of 2,4-bis(1-aziridinylcarbonylamino)toluene, bis[4-(1-aziridinylcarbonylamino)-phenyl]methane, bis(3-chloro-4-(1-aziridinylcarbonylamino)phenyl)methane, 2,2-bis(4-(1-aziridinylcarbonyloxy)phenyl)propane, 1,4-bis(1-aziridinylcarbonyloxy)benzene, and 1,4-bis(1-aziridinylcarbonyl)-benzene.

The aziridine compounds can be employed alone or as a mixture of two or more thereof.

The organic epoxy compounds usable for the colored image-stabilizing agent are preferably selected from the group consisting of the compounds of the formulae 1) to 15):

1) 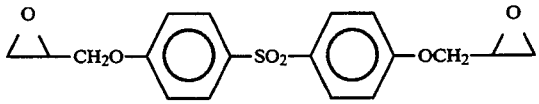

2) 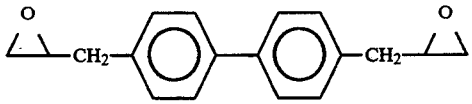

3) 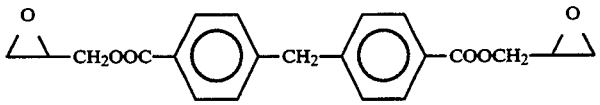

4) 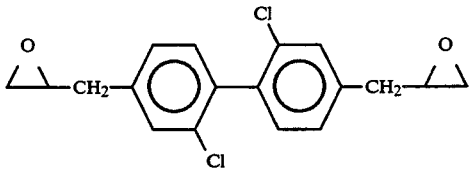

5) 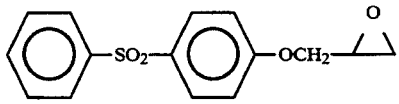

6) 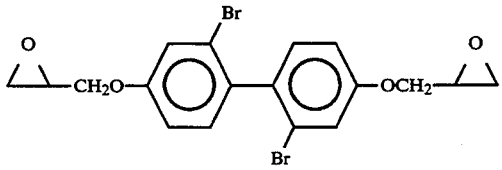

7) 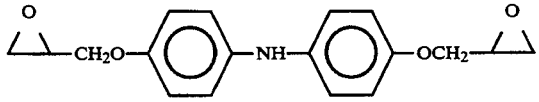

-continued

8) 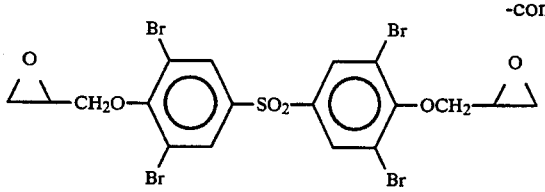

9) 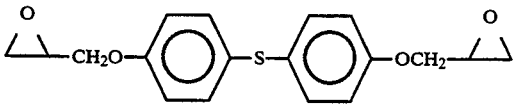

10) 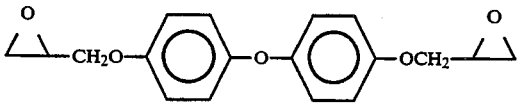

11) 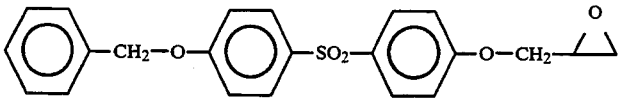

12) 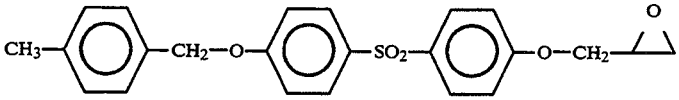

13) 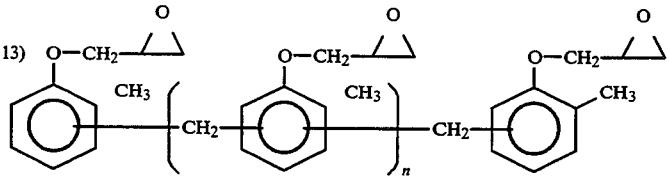

in which formula 13), n represents an integer of 1 to 10,

14) 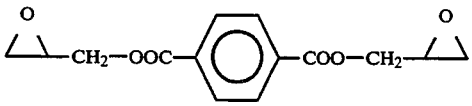

and

15) 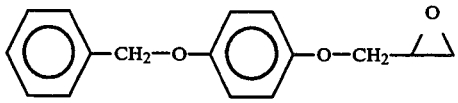

and

The dye precursor usable for the present invention comprises at least one member selected from conventional triphenylmethane, fluoran, and diphenylmethane leuco dyes, for example, 3-(4-diethylamino-2-ethoxyphenyl)-3-(1-ethyl -2-methylindole-3-il)-4-azaphthalide, crystal violet lactone, 3-(N-ethyl-N-isopentylamino)-6-methyl-7-anilinofluoran, 3-diethylamino-6-methyl-7-anilinofluoran, 3-diethylamino-6-methyl-7- (2', 4'-dimethyl-anilino) fluoran, 3-(N-ethyl-N-p-toluidino)-6-methyl-7-anilinofluoran, 3-pyrrolidino-6-methyl-7-anilinofluoran, 3-dibutylamino-6-methyl-7-anilinofluoran, 3-(N-cyclohexyl-N-methylamino)-6-methyl-7-anilinofluoran, 3-diethylamino-7-(o-chloroanilino)fluoran, 3-diethylamino-7-(m-trifluoromethylanilino)fluoran, 3-diethylamino-6-methyl-7-chlorofluoran, 3-diethylamino-6-methylfluoran, 3-cyclohexylamino-6-chlorofluoran and 3-(N-ethyl-N-hexylamino)-6-methyl-7-(p-chloroanilino)fluoran.

The binder usable for the present invention preferably comprises at least one member selected from water-soluble polymeric materials, for example, various types of polyvinyl alcohol resins which have a different molecular weight from each other, starch and starch derivatives, cellulose derivatives, for example methoxy cellulose, carboxymethyl cellulose, methyl cellulose and ethyl cellulose, sodium polyacrylate, polyvinyl pyrrolidine, acrylic acid amide-acrylic acid ester copolymers, acrylic acid amide-acrylic acid ester-methacrylic acid terpolymers, alkali salts of styrene-maleic anhydride copolymers, polyacrylic acid amide, sodium alginate, gelatine and casein, and water-insoluble polymeric materials, for example, polyvinyl acetate resins, polyurethane resins, styrene-butadiene copolymer resins, polyacrylic acid resins, polyacrylic acid ester resins, vinyl chloride-vinyl acetate copolymer resins, polybutyl acrylate, ethylene-vinyl acetate copolymer resins and styrene-butadiene-acrylic compound-terpolymer resins, used in the form of a latex.

In the thermosensitive colored image-forming layer of the present invention, the dye precursor is present in an amount of 5 to 20% of weight, the color developing agent is present in an amount of 5 to 40% by weight, the colored image-stabilizing agent is present in an amount of 1 to 30% by weight, and the binder is present in an amount of 5 to 20% by weight, based on the total dry weight of the colored image-forming layer.

The color developing agent contains the diphenol carboxylic acid compound of the formula (I) in an amount of 30 to 100% by weight and the conventional color developing compound in an amount of 0 to 70% by weight.

When the diphenol carboxylic acid of the formula (I) and the color-developing agent are employed in an amount smaller than the above-mentioned lower limits thereof, the resultant colored images exhibit an unsatisfactory resistance to the oily and fatty substances and plasticizers. Also, even if the compound of the formula (I) and the colored image-stabilizing agent are employed in amounts more than the above-mentioned upper limits thereof, the colored image-stabilizing effect are saturated, and thus the resultant colored image-forming layer is disadvantageous in having a high cost.

The thermosensitive colored image-forming layer of the present invention optionally further comprises a heat-fusible organic substance, usually referred to as a sensitizing agent, inorganic and organic pigments, antioxidants, for example, hindered phenol compounds, ultraviolet ray-absorbers, and waxes.

The sensitizing agent comprises at least one organic compound having a melting point of from 50° to 160° C., for example, phenyl 1-hydroxy-2-naphthoate (JP-A-57-191,089), p-benzyl-biphenyl (JP-A-60-82,382), benzylnaphthylether (JP-A-58-87,094), dibenzyl terephthalate (JP-A-58-98,285), benzyl p-benzyloxybenzoate (JP-A-57-201,691), diphenyl carbonate, ditolyl carbonate (JP-A-58-136,489), m-terphenyl (JP-A-57-89,994), 1,2-bis(m-tolyloxy)ethane (JP-A-60-56,588), 1,5-bis(p-methoxyphenoxy)-3-oxapentane (JP-A-62-181,183), oxalic acid diesters (JP-A-64-1,583) and 1,4-bis(p-tolyloxy)benzene (JP-A-2-153,783).

The inorganic and organic pigments usable for the present invention are preferably selected from inorganic fine particles of, for example, calcium carbonate, silica, zinc oxide, titanium dioxide, aluminum hydroxide, zinc hydroxide, barium sulfate, clay, anhydrous clay, talc, and surface-treated calcium carbonate and silica and organic fine particles of, for example, urea-formaldehyde resins, styrene-methacrylate copolymer resins and polystyrene resins.

The waxes usable for the present invention preferably comprise at least one member selected from, for example, paraffin waxes, carnauba wax, microcrystalline waxes, polyethylene waxes, amide type waxes, bisimide type waxes, higher fatty acid amide waxes, for example, stearic acid amide, ethylene-bis-stearoamide wax, higher fatty acid esters and metal salts, for example, zinc stearate, aluminum stearate calcium stearate, and zinc oleate.

In the colored image-forming layer of the present invention, the sensitizing agent is preferably contained in an amount of 5 to 40% by weight, the wax and organic or inorganic pigment are optionally contained in amounts of 2 to 20% by weight and 5 to 50% by weight, respectively, based on the total dry weight of the colored image-forming layer.

The sheet substrate usable for the present invention is not limited to a specific group of materials. Usually the sheet substrate comprises a member selected from fine paper sheets, coated paper sheets having a clay or latex-coated layer, cast-coated paper sheets, paper boards, plastic resin films, synthetic paper sheets comprising a plastic resin such as a polyolefin resin and a multi-layer structure, and laminated composite sheets. Preferably, the sheet substrate has a basis weight of 40 to 170 g/m$^2$.

The colored image-forming layer can be formed on a surface of a sheet substrate, by applying a coating liquid containing the above-mentioned components, and by drying and solidifying the coating liquid layer on the sheet substrate.

The colored image-forming layer is preferably present in a dry weight of from 1 to 15 g/m$^2$, more preferably 2 to 10 g/m$^2$.

In the present thermosensitive recording material, a protective layer and/or a printed layer may be formed on the colored image-forming layer.

The thermosensitive recording material of the present invention is advantageous in that it has an excellent capability of recording thereon clear colored images having a high resistance to oily and fatty substances and plasticizers even immediately after a color formation thereof, and a superior persistency for a long time, due to the combined use of the color developing diphenol carboxylic acid compound of the formula (I) with the specific colored image-stabilizing agent comprising at least one member selected from organic aziridine compounds and organic epoxy compounds.

EXAMPLES

The present invention will be further explained by the following specific examples, which are merely representative and do not in any way restrict the scope of the present invention.

Example 1

A thermosensitive recording paper sheet was prepared by the following procedures.

(1) Preparation of an Aqueous Dye Precursor Dispersion A in the Following Composition

| Component | Part by weight |
|---|---|
| 3-(N-isopentyl-N-ethylamino)-6-methyl-7-anilinofluoran | 20 |
| 10% aqueous solution of polyvinyl alcohol | 10 |
| Water | 70 |

The composition was dispersed in a sand grinder to an extent such that the resultant dispersed solid particles had an average size of 1 μm or less.

(2) Preparation of an Aqueous Color-Developing Agent Dispersion B in the Following Composition

| Component | Part by weight |
|---|---|
| 4,4-bis(4-hydroxyphenyl) pentanic acid | 20 |
| 10% aqueous solution of polyvinyl alcohol | 10 |
| Water | 70 |

The composition was dispersed in a sand grinder to an extent such that the resultant dispersed solid particles had an average size of 1 μm or less.

(3) Preparation of an Aqueous Aziridine Compound Dispersion C in the Following Composition

| Component | Part by weight |
|---|---|
| Bis[4-(1-aziridinylcarbonyl-amino)phenyl]methane | 20 |
| 10% aqueous solution of polyvinyl alcohol | 10 |

-continued

| Component | Part by weight |
|---|---|
| Water | 70 |

The composition was dispersed in a sand grinder to an extent such that the resultant dispersed solid particles had an average size of 1 μm or less.

(4) Preparation of a Pigment-Coated Paper Sheet

A coating liquid was prepared by mixing an aqueous dispersion, prepared by dispersing 85 parts by weight of anhydrous clay available under the trademark of Ansilex, from Engelhard Corporation, in 320 parts by weight of water, with 40 parts by weight of an aqueous emulsion of a styrene-butadiene copolymer in a solid concentration of 50% by weight and 50 parts by weight of a 10% aqueous oxidized starch solution.

The coating liquid was coated on a surface of a fine paper sheet having a basis weight of 48 g/m$^2$, to form a coating layer having a dry weight of 7.0 g/m$^2$, whereby a coated paper sheet was obtained.

(5) Formation of Thermosensitive Colored Image-Forming Layer

A coating liquid was prepared by evenly mixing 60 parts by weight of the aqueous dye precursor dispersion A, 120 parts by weight of the aqueous color-developing agent dispersion B, and 60 parts by weight of the aqueous aziridine compound dispersion C with 30 parts by weight of an anhydrous clay, 20 parts by weight of a 25% aqueous zinc stearate dispersion, 15 parts by weight of 30% aqueous paraffin dispersion, and 120 parts by weight of a 10% aqueous polyvinyl alcohol solution, by agitating the mixture.

A surface of the pigment coated paper sheet was coated with the resultant coating liquid and dried. A thermosensitive colored image-forming layer was formed in a weight of 5.0 g/m$^2$, to provide a thermosensitive recording paper sheet.

The recording sheet was treated by a super calender, and the calendered surface of the recording sheet had a Bekk smoothness of 600 to 1000 seconds.

(6) Test (i) A specimen of the resultant thermosensitive recording sheet was subjected to a colored image-developing test in 64 lines by using a dynamic color-developing tester provided by modifying a thermosensitive facsimile printer, at a one line recording time of 10 m sec., at a scanning line density of 8×8 dot/mm, and with an applied energy of 0.54 mj/dot. The resultant black colored images were clear and had a high color density of 1.2 or more determined by a Macbeth Reflection Color Density Tester RD-914.

(ii) The color image-developed specimen was subjected within 30 minutes from the completion of the color image-developing procedure to a salad oil resistance test in such a manner that a salad oil was applied to the color image-developed surface of the specimen by using a cotton applicator, the salad oil-applied specimen was left to stand at room temperature for 30 minutes, and thereafter, the remaining colored images were evaluated by a naked eye observation.

(iii) The same test operations as in the salad oil resistance test (ii) were carried out except that the salad oil was replaced by dioctylphthalate, to measure the resistance of the colored images to the plasticizer.

The results of the above-mentioned tests are shown in Table 1.

Example 2

A thermosensitive recording sheet was produced by the same procedures as in Example 1, with the following exceptions.

(1) Preparation of an Aqueous Sensitizing Agent Dispersion D in the Following Composition

| Component | Part by weight |
|---|---|
| Dibenzyl oxalate | 20 |
| 10% aqueous solution of polyvinyl alcohol | 10 |
| Water | 70 |

The composition was dispersed in a sand grinder to an extent such that the resultant dispersed solid particles had an average size of 1 μm or less.

(2) Formation of Thermosensitive Colored Image-Forming Layer

A coating liquid was prepared by evenly mixing 50 parts by weight of the aqueous dye precursor dispersion A, 90 parts by weight of the aqueous color-developing agent dispersion B, and 60 parts by weight of the aqueous colored image-stabilizing agent dispersion C mentioned in Example 1 with 90 parts by weight of the aqueous sensitizing agent dispersion D, 27 parts by weight of anhydrous clay pigment, 20 parts by weight of a 25% aqueous zinc stearate dispersion, 15 parts by weight of a 30% aqueous paraffin dispersion, and 120 parts by weight of a 10% aqueous polyvinyl alcohol solution, by agitating the mixture.

A surface of a paper sheet having a basis weight of 50 g/m$_2$ was coated with the resultant coating liquid and dried. A thermosensitive colored image-forming layer was formed in a weight of 5.0 g/m$^2$, to provide a thermosensitive recording paper sheet.

The recording sheet was surface treated by a super calender, in the same manner as in Example 1.

A specimen of the resultant thermosensitive recording sheet was subjected to the same tests as in Example 1.

The test results are shown in Example 1.

Example 3

A thermosensitive recording sheet was produced by the same procedures as in Example 1 except that, in the preparation of the aqueous colored image-stabilizing agent dispersion C, the bis(4-(1-aziridinylcarbonylamino)phenyl)methane was replaced by the epoxy compound of the formula (1).

The test results are shown in Table 1.

Example 4

A thermosensitive recording sheet was produced by the same procedures as in Example 1 except that, in the preparation of the aqueous color developing agent dispersion B, the 4,4-bis(4-hydroxyphenyl)pentanic acid was replaced by 3,3-bis(4-hydroxyphenyl)butanic acid, and in the preparation of the aqueous colored image-stabilizing agent dispersion C, the bis(4-(1-aziridinylcarbonylamino)phenyl)methane was replaced by the epoxy compound of the formula (13).

The test results are shown in Table 1.

Example 5

A thermosensitive recording sheet was produced by the same procedures as in Example 1 except that, in the preparation of the aqueous color developing agent dispersion B, the 4,4-bis(4-hydroxyphenyl)pentanic acid was replaced by 3,3-bis(3-chloro-4-hydroxyphenyl)butanic acid.

The test results are shown in Table 1.

Example 6

A thermosensitive recording sheet was produced by the same procedures as in Example 1 except that, in the preparation of the aqueous color developing agent dispersion B, the 4,4-bis(4-hydroxyphenyl)pentanic acid was replaced by bis(4-hydroxyphenyl)acetic acid.

The test results are shown in Table 1.

Comparative Example 1

A thermosensitive recording sheet was produced by the same procedures as in Example 1 except that, in the preparation of the aqueous color developing agent dispersion B, the 4,4-bis(4-hydroxyphenyl)pentanic acid was replaced by 2,2-bis(4-hydroxyphenyl)propane, namely bisphenol A, and in the preparation of the coating liquid for the color image-forming layer, the aqueous dispersions A and B were employed in amounts of 80 parts and 160 parts by weight, respectively, and the aqueous dispersion C was not employed.

The test results are shown in Table 1.

Comparative Example 2

A thermosensitive recording sheet was produced by the same procedures as in Example 1 except that, in the preparation of the aqueous color developing agent dispersion B, the 4,4-bis(4-hydroxyphenyl)pentanic acid was replaced by 2,2-bis(4-hydroxyphenyl)propane-(bisphenol A).

The test results are shown in Table 1.

Comparative Example 3

A thermosensitive recording sheet was produced by the same procedures as in Example 2 except that, in the preparation of the coating liquid for the colored image-forming layer, the aqueous dispersion A was used in an amount of 62 parts by weight, the aqueous dispersion B was employed in an amount of 114 parts by weight, and the aqueous dispersion C was omitted.

The test results are shown in Table 1.

Comparative Example 4

A thermosensitive recording sheet was produced by the same procedures as in Example 4 except that, in the preparation of the coating liquid for the colored image-forming layer, the aqueous dispersions A and B were employed in amounts of 62 parts and 114 parts by weight, respectively, and the dispersion D was used in an amount of 114 parts by weight.

The test results are shown in Table 1.

TABLE 1

| Example No. | | Item: Resistance of colored image to salad oil (*)$_1$ | Item: Resistance of colored image to dioctylphthalate (*)$_1$ |
|---|---|---|---|
| Example | 1 | 4 | 4 |
| | 2 | 4 | 4 |
| | 3 | 4 | 3 |
| | 4 | 4 | 3 |
| | 5 | 4 | 4 |
| | 6 | 4 | 4 |
| Comparative Example | 1 | 1 | 1 |
| | 2 | 2 | 1 |
| | 3 | 3 | 2 |
| | 4 | 3 | 1 |

Note: (*)$_1$
class 4 . . . The remaining images were very clear.
class 3 . . . The remaining images were readable.
class 2 . . . The remaining images were not readable.
class 1 . . . The images were completely faded.

Table 1 clearly demonstrates that the excellent resistance of the colored images formed on the thermosensitive recording sheets of the present invention to the oily and fatty substances and plasticizers is realized by the combined use of the color developing diphenol carboxylic acid compound of the formula (I) with the specific colored image-stabilizing agent (an organic aziridine and/or an organic epoxy compound). The necessity of the inclusion of the diphenol carboxylic acid compound of the formula (I), for obtaining a high resistance of the colored images to the oily and fatty substances and plasticizers, is clearly illustrated by a comparison of Example 1 with Comparative Example 2. Also, the necessity for the inclusion of the specific colored image-stabilizing agent of the present invention for the above-mentioned purpose is clearly illustrated by a comparison of Examples 1 to 3 with Comparative Example 3, or of Example 4 with Comparative Example 4.

We claim:

1. A thermosensitive recording material comprising:

a substrate sheet and a thermosensitive colored image-forming layer formed on a surface of the substrate sheet and comprising a substantially colorless dye precursor, a color developing agent reactive with the dye precursor upon heating to thereby develop a color, and a binder, said color developing agent comprising at least one diphenol carboxylic acid compound of the formula (I):

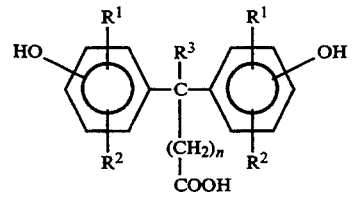

(I)

wherein $R^1$ and $R^2$ respectively and independently from each other represent a member selected from the group consisting of hydrogen and halogen atoms and alkyl, alkoxyl, acyl and aryl groups, $R^3$ represents a member selected from the group consisting of a hydrogen atom and alkyl groups, and n represents zero or an integer of from 1 to 8, and the colored image-forming layer further comprising a colored image-stabilizing agent comprising at least one member selected from the group consisting of organic aziridine compounds having at least one aziridinyl group and organic epoxy compounds having at least one epoxy group.

2. The thermosensitive recording material as claimed in claim 1, wherein the diphenol carboxylic acid compounds of the formula (I) are selected from the group consisting of bis(4-hydroxyphenyl)acetic acid, 3,3-bis(4-hydroxyphenyl)butanic acid, 4,4-bis(4-hydroxyphenyl)-pentanic acid, 2,2-bis(4-hydroxyphenyl)propionic acid, 4,4-bis(4-hydroxyphenyl)hexanic acid, 6,6-bis(4-hydroxyphenyl)heptanic acid, 4,4-bis(4-hydroxyphenyl)octanic acid, 2,2-bis(3-methyl-4-hydroxyphenyl)propionic acid, 3,3-bis(3-methyl-4-hydroxyphenyl)butanic acid, 4,4-bis(3-methyl-4-hydroxyphenyl)tentanic acid, 4,4-bis(2-methyl-4-hydroxyphenyl)pentanic acid, 3,3-bis(4-hydroxyphenyl)propionic acid, 4,4-bis(4-hydroxyphenyl)butanic acid, 3,3-bis(3-hydroxyphenyl)butanic acid, 3,3-bis(3-methoxy-4-hydroxyphenyl)butanic acid, 3,3-bis(3-chloro-4-hydroxyphenyl)butanic acid, 3,3-bis(3-acetyl-4-hydroxyphenyl)butanic acid, and 3,3-bis(3-phenyl-4-hydroxyphenyl)butanic acid.

3. The thermosensitive recording material as claimed in claim 1, wherein the diphenylcarboxylic acid compound of the formula (I) is present in a content of 5 to 40% by weight based on the total dry weight of the thermosensitive colored image-forming layer.

4. The thermosensitive recording material as claimed in claim 1, wherein the colored image-stabilizing agent is present in a content of 1 to 30% by weight based on the total dry weight of the thermosensitive colored image-forming layer.

5. The thermosensitive recording material as claimed in claim 1, wherein the aziridine compound for the colored image-stabilizing agent is selected from the group consisting of 2,4-bis(1-aziridinylcarbonylamino)-toluene, bis(4-(1-aziridinylcarbonylamino)phenyl)methane, bis(3-chloro-4-(1-aziridinylcarbonylamino)-phenyl)methane, 2,2-bis(4-(1-aziridinylcarbonyloxy)-phenyl)propane, 1,4-bis(1-aziridinylcarbonyloxy)benzene and 1,4-bis(1-aziridinylcarbonyl)benzene.

6. The thermosensitive recording material as claimed in claim 1, wherein the aromatic epoxy compound for the colored image-stabilizing agent is selected from the group consisting of the compounds of the formulae 1) to 15):

1) 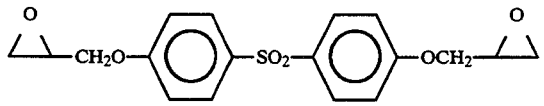

2) 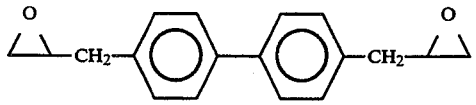

3) 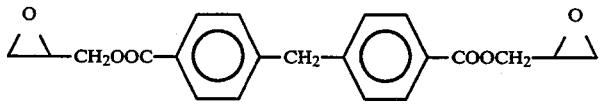

4) 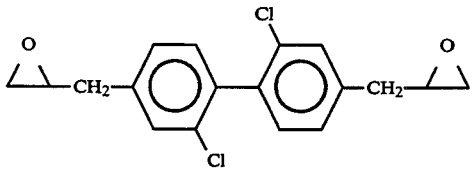

5) 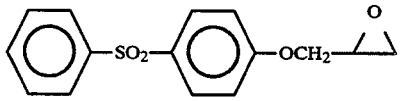

6) 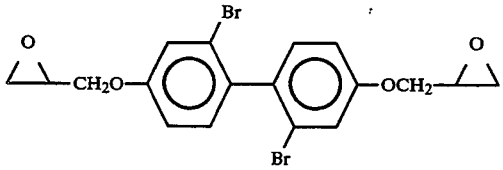

7) 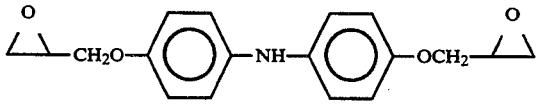

-continued
8) 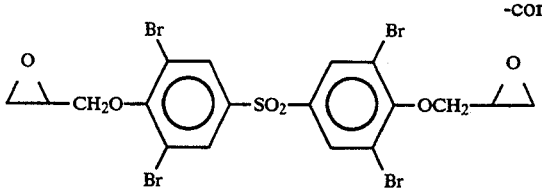
9) 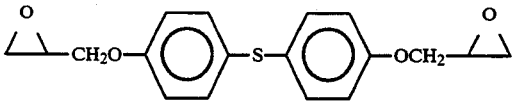
10) 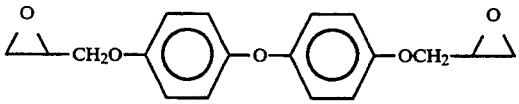
11) 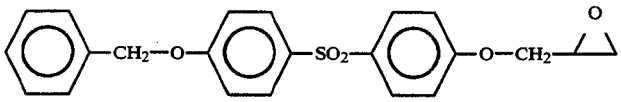
12) 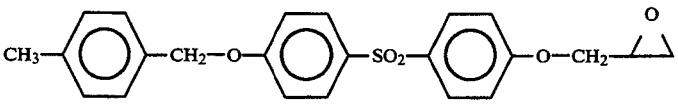
13) 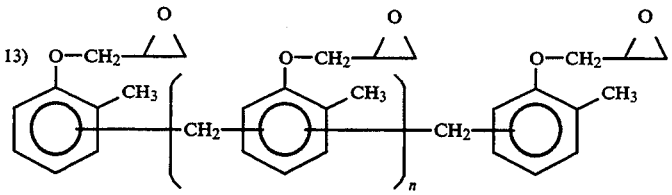
in which formula 13), n represents an integer of 1 to 10,
14) 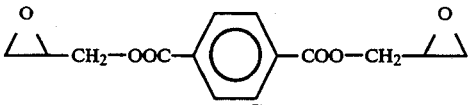
and
-continued
15) 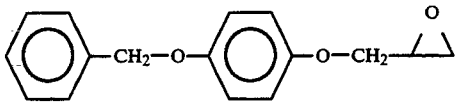
in which formulae 1) to 15), the symbol
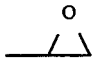
represents an epoxy group of the formula
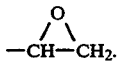
* * * * *